US005381322A

United States Patent [19]

Humphreys

[11] Patent Number: 5,381,322

[45] Date of Patent: Jan. 10, 1995

[54] LIGHT KNUCKLE WITH BALLAST

[75] Inventor: Michael P. D. Humphreys, Santa Rosa, Calif.

[73] Assignee: Humphreys Injection Molds, Inc., Santa Rosa, Calif.

[21] Appl. No.: 899,631

[22] Filed: Jun. 15, 1992

[51] Int. Cl.[6] ..... F21S 3/00; F21V 21/30

[52] U.S. Cl. ..... 362/220; 362/221; 362/260; 362/427

[58] Field of Search ..... 362/260, 217, 220, 221, 362/287, 413, 418, 427, 222

[56] References Cited

U.S. PATENT DOCUMENTS 2,347,174 4/1944 Cross et al. .
3,112,891 12/1963 Cutler .
3,254,205 5/1966 Cobb .
3,755,665 8/1973 Grindle ..... 362/418
3,833,801 9/1974 Trevithick .
3,991,905 11/1976 Nicpon ..... 362/260
4,323,953 4/1982 Hutchison .
4,460,948 7/1984 Malola ..... 362/418
4,485,443 1/1985 Cummings .
4,626,975 12/1986 Miletich ..... 362/418
4,691,267 9/1987 Giesberg .
4,713,819 12/1987 Gaynor .
4,760,511 7/1988 Russello et al. ..... 362/427
4,779,178 10/1988 Spitz .
4,782,428 11/1988 Lowell et al. .

*Primary Examiner*—Richard R. Cole
*Attorney, Agent, or Firm*—Douglas E. White

[57] ABSTRACT

A floodlight knuckle or pivot joint has a ballast incorporated into it, rather than into the housing or hood of the fixture that holds the reflector and lamp. Preferably, the ballast is incorporated into its own waterproof housing in the lower portion of a vertically oriented knuckle, below the bottom-most of the two flanges of the knuckle, i.e. so that the pivot flanges are disposed between the ballast-containing portion of the knuckle and the fixture hood. Alternatively, the ballast might be contained in the top channel of the knuckle (between the top flange and the fixture hood), or, perhaps, in an enlargement of one of the flanges.

23 Claims, 2 Drawing Sheets 244
248
253
256
257
250
255
252
254
242
260
239
230
220
216
201
218
217
219
224
220
210
234
212
238
232
204
208

319

301
318
316
310
332

LIGHT KNUCKLE WITH BALLAST

FIELD OF THE INVENTION

This invention relates to pivot joints for light fixtures, more particularly to a hollow-core pivot joint containing an electrical ballast coil.

BACKGROUND OF THE INVENTION

Fluorescent lamps require an electromagnetic ballast coil (inductor) having a circuit for limiting the current flow to the lamp. To protect the electrical ballast from the elements, prior outdoor fluorescent floodlights shelter the ballast in the same housing or hood of the fixture as the reflector and the lamp. This results in space being wasted in the hood for holding the ballast—which space, if somehow made available, could better be used either for accommodating a larger reflector or for making the fixture smaller overall. Furthermore, the ballast gives off a relatively large amount of heat, which heat can cause problems when confined within the hood of the fixture. To prevent warping or melting, plastic fixtures may require an open area around the ballast, or other type of heat sink. This results in even more wasted space and design clutter.

An additional problem with the accumulation of heat within the hood is that the light output of the fluorescent lamp will decline.

With or without a metal heat sink, the considerable weight of a ballast makes the hood top-heavy. Since such hoods typically are rotatably adjustable about an arc in a vertical plane, gravity readily will cause top-heavy hoods to fall down out of position should the pivot joint be at all loose. Over time, vibration can cause such joints to come loose, necessitating adjustment of the hood. Considering that many of these flood lights are installed in out of the way locations, such as on elevated billboards, this can be a very time and labor consuming process.

Additionally, the heating of the interior of the hood which does occur can cause the reflector lens to fog up, due to the expansion and contraction of the excessive air volume of prior art fixtures. To prevent this, the hood may require open grills, weep holes, or other types of ventilation—resulting in loss of water repellency. Few, if any, out-door fluorescent floodlights are UL (Underwriters Laboratory) "wet-location listed." None so listed are known to the present inventor.

Commonly, the hood of a prior art floodlight is attached to a screw-biased knurled pivot joint, known in the art as a "knuckle," which knuckle joint allows the direction, of the light beam to be rotatably adjusted about the transverse pivot axis of the joint (typically upward and downward, as noted above). This pivot joint also functions as a bracket for attaching the fixture to a stake or pipe in the ground, through which protective ground pipe and knuckle is led the conductive electrical wiring.

Prior art knuckles may be described as comprising a bottom pipe to which is attached a first (usually bottom-most) knurled flange. A second (usually topmost) knurled flange mates with the first. The latter is pivotally rotatable about a transverse axis passing through both flanges. Rotational adjustment is accomplished by loosening a bolt whose axis coincides with said transverse pivot axis and which bolt holds the two flanges together. The top flange leads to a top pipe, or other hollow channel, which communicates with the interior of the hood of a prior art floodlight. Fully-sheltered electrical wiring passes from the ground pipe through the hollow bottom pipe, thence through the flanges, through the hollow top pipe, and finally into the hood of the fixture, where it is attached to a ballast contained within the hood.

Prior developments in this field may be generally illustrated by reference to the following information disclosure statement:

| Patent No. | Patentee | Issue Date |
|---|---|---|
| 4,782,428 | R. Lowell et al. | Nov. 01, 1988 |
| 4,779,178 | R. Spitz | Oct. 18, 1988 |
| 4,323,953 | M. Hutchison | Apr. 06, 1982 |
| 4,495,443 | J. Cummings | Jan. 22, 1985 |
| 4,713,019 | E. Gaynor | Dec. 15, 1987 |
| 3,254,205 | D. Cobb | May 31, 1966 |
| 3,833,801 | T. Trevithick | Sep. 03, 1974 |
| 2,347,174 | K. Cross et al. | Apr. 25, 1944 |
| 4,691,267 | D. Giesberg | Sep. 01, 1987 |
| 3,112,891 | C. Cutler | Dec. 03, 1963 |

U.S. Pat. Nos. 4,782,428 and 4,779,178 teach fluorescent light fixtures that are adjustably supported. Both have the ballast outside the light hood near to a pivot flange. In the case of the '428 patent, the ballast 14 is affixed to the pivot clamp 18*a* and rotates therewith. However, that particular pivot clamp is not associated with the post 4. Importantly, the wire 42 thereof does not lead through the inter:Lot of the pivot clamps or the pipe and, thus, would be exposed to the elements during outdoor use.

U.S. Pat. Nos. 3,254,205 and 4,323,953 teach adjustable fluorescent floodlights.

U.S. Pat. Nos. 3,833,801 and 2,347,174 teach fluorescent lights where the ballasts are in compartments separate from the lamps.

The rest of the patents are representative of what is in the art.

SUMMARY OF THE INVENTION

The present invention is a floodlight knuckle or pivot joint which has a ballast and associated wiring incorporated into its interior, rather than into the housing or hood of the fixture that holds the reflector and lamp. Preferably, the ballast is incorporated into its own waterproof housing in the lower portion of a vertically oriented knuckle, below the bottom-most of the two flanges of the knuckle, i.e. so that the pivot flanges are disposed between the ballast-containing portion of the knuckle and the fixture hood. In this manner, the ballast will not make the hood top-heavy, indeed, its weight does not bear upon the pivot joint at all, being entirely supported by the fixed support pipe or stake. Obviously, if the fixture is supported from above so as to be disposed below the pivot joint, then the ballast will preferably be located in the uppermost portion of the pivot joint, but still with the flanges between it and the hood—again, to take the weight out of the rotatable portion of the fixture.

Alternatively, the ballast might be contained in the top channel of the knuckle (between the top flange and the fixture hood), or, perhaps, in an enlargement of one of the flanges. However, while retaining many of the excellent heat-dissipation and space-saving benefits of this invention, these latter configurations might make it difficult to design an aesthetically pleasing and stable fixture.

FEATURES AND ADVANTAGES

Incorporating the ballast into the pivot joint allows the hood housing of the fixture to be reduced in size, or the reflector to be increased in size, or both. Furthermore, the hood itself may be formed in a parabolic shape, the interior surface of which may be coated or lined reflectively to form an integrated hood/reflector—eliminating entirely the need for a fixture hood shaped separately from the reflector. Preferably, the top pipe of the knuckle also will be eliminated as a separate piece, i.e. the second (top) hollow pivot flange may be formed as an integral part of the rear of the hood/reflector and lead directly therein.

A further advantage is that this fixture should be capable of being fully sealed and rendered waterproof. With the ballast moved out of the hood, it obviously will not generate heat therein. What little heat is generated by the lamp will not cause enough condensation to require ventilation of the hood. Therefore, the only openings needed in the hood/reflector will be one in the front to accommodate the removable transparent lens and one in the rear through which the wiring is fed. Both areas can be sealed relatively easily, the first by the congruent mating of the lens and hood and the second by the congruent mating of the pivot joint flange faces. Appropriate gaskets or sealing resins can be added where needed.

The ballast will be permanently sealed in its housing in the bottom pipe of the knuckle. In fact, it may be "potted" therein, i.e. dipped in or filled with liquid plastic resin, so to form a completely waterproof seal (which seal then comprises the ballast housing). The ballast will be able to dissipate heat through direct radiation out of its housing. Alternatively, its housing may incorporate a metal heat sink.

Yet another advantage of removing the ballast from the hood is that the hood/reflector may be made of less heat-resistant material. The hood and nearly all of its contents may be fabricated from plastic resin, further reducing weight and cost.

Probably the most important benefits which are derived from separating the ballast from the hood are that the hood will not become heat-saturated and that the volume of air in the hood will be greatly reduced. Reducing the volume of air will make waterproofing the fixture practical, as one will not have to contend with as much expansion and contraction of trapped air due to temperature changes.

Therefore, a fixture constructed with the ballast knuckle of this invention will be able to have a hood that is smaller and lighter overall, and/or incorporates a larger reflector, than prior fixtures having the same size lamp and ballast. Furthermore, the fixture should be able to achieve the desirable Underwriters Laboratory "wet-location" listing.

An object of this invention is to disclose a pivot joint apparatus for a fluorescent light fixture which includes a first pivot member having a first aperture in a first planar face, the first face lying perpendicular to a transverse axis. Also included is ballast means for a fluorescent lamp which ballast means is contained within the first member. A second pivot member has a second aperture in a second planar face, the second face parallel to the first, the faces rotatable with respect to each other about the axis so that the apertures are sealed externally but remain in open communication with each other when the faces are pressed flush together. The apparatus further includes electrically conductive wire passing from the ballast through the apertures.

Another object or feature is a fluorescent light fixture apparatus including a hood containing a socket for a fluorescent lamp; including a pivot joint having first and second pivot flanges rotatably pressed together in interlocking relationship; including a housing for a ballast for limiting the current flow to the socket, the housing connected to one of the pivot flanges; and including electrically conductive wire operatively connecting the ballast and the socket. The housing and pivot joint form a single interconnected interior cavity through which the wire passes.

Another feature is an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, such words as "upwardly," "downwardly," "leftwardly" and "rightwardly" will refer to directions in the drawings to which reference is made unless otherwise stated. Similarly, such words as "inwardly" and "outwardly" will refer to directions toward and away from, respectively, the geometric center of a device and designated parts thereof.

Figures 1, 2, 3:
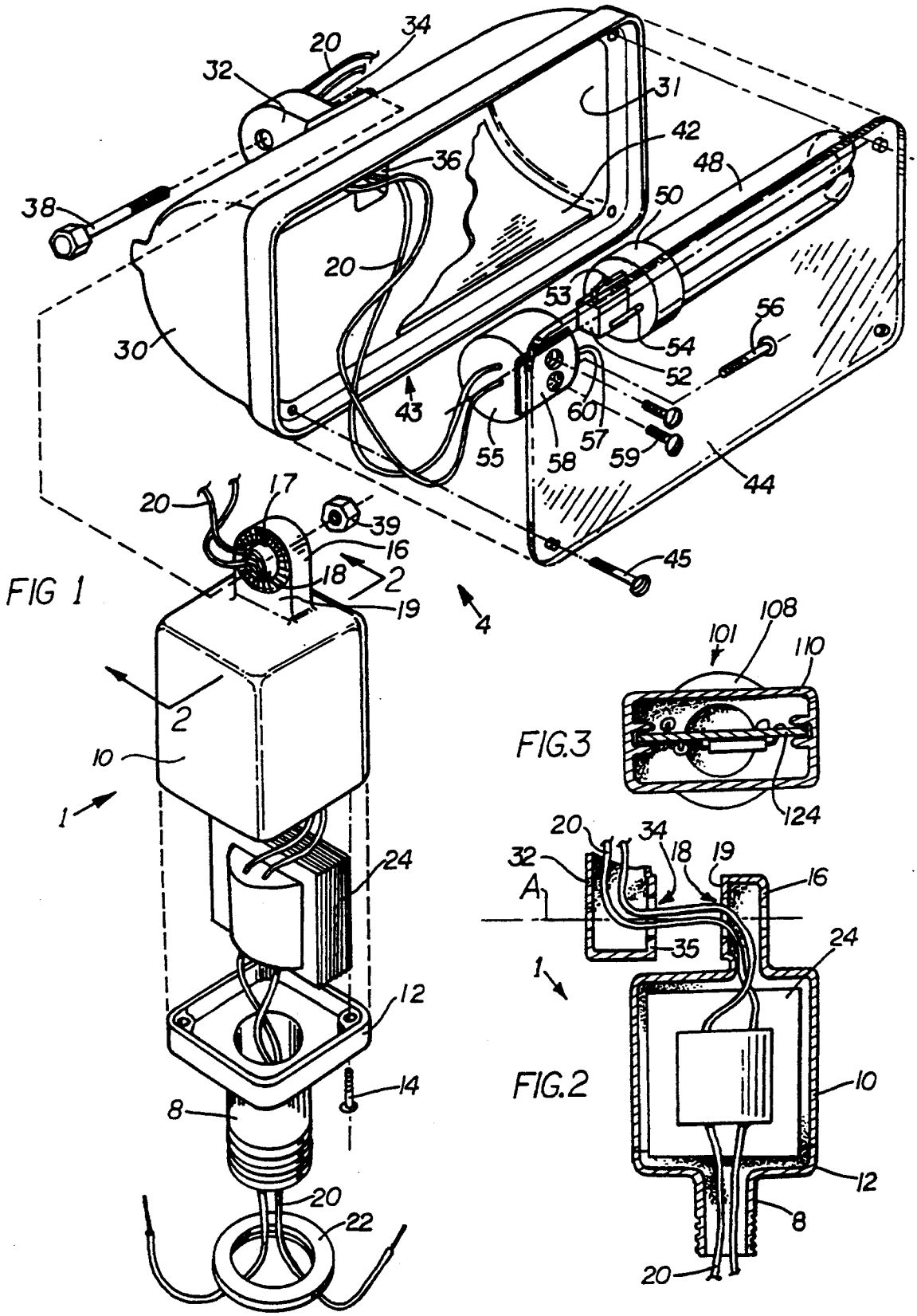
FIG. 1 is an exploded perspective view of a fixture incorporating the pivot joint of this invention.
FIG. 2 is a sectional front elevation of the lower portion of the pivot joint of FIG. 1, taken along line 2—2 of FIG. 1.
FIG. 3 is a sectional top plan view of an alternate embodiment of the pivot joint.

| Drawing Reference Numerals | |
|---|---|
| A | axis of 18, 34 |
| 1 | pivot joint |
| 4 | fixture |
| 8 | pipe of 1 |
| 10 | housing of 24 |
| 12 | base of 10 |
| 14 | screw for 10, 12 |
| 16 | bottom flange of 1 |
| 17 | knurls on 16 |
| 18 | aperture in 19 for 20 |
| 19 | face of 16 |
| 20 | conductive wire |
| 22 | washer |
| 24 | ballast |
| 30 | hood of 4 |
| 31 | side of 30 |
| 32 | top flange |
| 34 | aperture in 35 for 20 |
| 35 | face of 32 |

-continued

| Drawing Reference Numerals | |
|---|---|
| 36 | channel in 32, 30 |
| 38 | bolt for 16, 32 |
| 39 | nut for 38 |
| 42 | reflector in 30 |
| 43 | opening in 30 for 44 |
| 44 | lens of 30 |
| 45 | screw for 30, 44 |
| 48 | lamp |
| 50 | base of 48 |
| 52 | base block of 50 |
| 53 | rib on 52 |
| 54 | contact pin on 50 |
| 55 | socket for 48 |
| 56 | screw for 30, 55 |
| 57 | aperture for 52 |
| 58 | plate on 55 |
| 59 | screw for 55, 58 |
| 60 | aperture for 54 |
| 101 | pivot joint |
| 108 | pipe of 101 |
| 110 | housing of 124 |
| 124 | ballast |
| 201 | pivot joint |
| 204 | fixture |
| 208 | pipe of 201 |
| 210 | housing of 224 |
| 212 | base of 210 |
| 216 | bottom flange of 201 |
| 217 | knurls on 216 |
| 218 | aperture in 219 for 220 |
| 219 | face of 216 |
| 220 | conductive wire |
| 224 | ballast |
| 230 | hood of 204 |
| 232 | top flange |
| 234 | aperture in 232 for 220 |
| 238 | bolt for 216, 232 |
| 239 | nut for 238 |
| 242 | reflector in 230 |
| 244 | lens of 230 |
| 248 | lamp |
| 250 | base of 248 |
| 252 | base block of 250 |
| 253 | rib on 252 |
| 254 | contact pin on 250 |
| 255 | socket for 248 |
| 256 | screw for 230, 255 |
| 257 | aperture for 252 |
| 260 | aperture for 254 |
| 301 | pivot joint |
| 310 | ballast housing |
| 316 | bottom "flange!" of 301 |
| 318 | aperture in 319 |
| 319 | face of 316 |
| 332 | top flange |

DESCRIPTION OF A PREFERRED EMBODIMENT

Referring to FIG. 1, there is illustrated therein a knuckle pivot joint 1 adapted within a fluorescent floodlight fixture 4. Fixture 4 is of the type presenting a reflective surface which is substantially parabolic along a plurality of parallel vertical sections (taken front to back), but all of whose horizontal sections are linear. In other words, the shape of the hood 30 of the fixture 4 is parabolic when viewed from the side, but is rectangular when viewed from the front. Such a fixture projects a relatively focused horizontal beam when used with a lamp 48 of the type commonly known as "compact", "super compact" or "mini" (miniature). These lamps have a U-shaped tube with parallel arms leading to a common base. Examples include those sold under the trade names and trademarks Philips PL, Philips PLC, Osram DULUX (S, D and E series), Sylvania TWIN-TUBE series, GE MOD-U-LINE, and the like. The advantage of such lamps is that they provide about as much light as a similar incandescent lamp, but require less than one-third the power. Furthermore, they may last ten times as long.

Assuming that the fixture 4 is to be supported from below, as drawn, the pivot joint 1 begins with a downwardly-depending hollow electrical conduit or pipe 8 (wire ingress means), which pipe leads to a base 12 of a housing 10 for a ballast coil 24. The base 12 may be releasably secured to the housing 10 with screws 14, or the ballast 24 may be permanently sealed within an integrally molded housing.

A first pivot flange 16, referred to herein, for convenience, as the bottom flange, projects upwardly from the ballast housing 10, to which housing it is molded or otherwise rigidly affixed. Preferably, radial ridges or knurls 17 project outwardly from an aperture 18 (wire egress means) that leads from the face 19 of the bottom flange 16 into the hollow interior thereof. These knurls act in concert with a mating top flange 32 of the hood 30 of the fixture 4 to hold the fixture steady in a selected orientation, as is common in the art. Alternatively, the engaged faces of the two flanges may be smooth.

Electrically conductive wire 20 may be directed from a standard junction box (not illustrated) into the pipe 8. The pipe may be screwed into the junction box and sealed with an appropriate washer 22, gasket or the like. Alternatively, a ground pipe or stake (not illustrated) may be interposed between the junction box and the pipe 8. From the junction box, the wire 20 is provided with a fully sealed path through the pipe 8 into the interior of the housing 10, where it connects with the ballast 24. From the ballast, conductive wire 20 leads up through the hollow interior of the bottom flange 16 and out of its aperture 18. Aperture 18 is sealed from the external environment by engagement with a congruent face 35 and co-axially mated aperture 34 of a second ("top") pivot joint flange 32. The flange 32 leads to a suitable fixture hood 30, as described below.

Although the invention may be considered to reside in the novel fluorescent floodlight fixture as a whole, in one broad aspect it is simply the pivot joint assembly thus far described, i.e. an electrical ballast sealed in a housing having at least one pivot face and aperture, through which housing and facial aperture conductive wire may be passed to a second axially-cooperating pivot face and aperture, wherein the wire is presented with a completely sealed path through the assembly. The second pivot face might be located on a pre-existing fixture, allowing the ballast knuckle to be retrofitted thereon or to be provided as a replacement part.

One preferred fixture incorporating the pivot joint ballast invention is fixture 4 of FIGS. 1 and 2. The second or top flange 32 for the novel pivot joint 1 is hollow, like the first or bottom flange 16. The top flange 32 is rigidly molded into or affixed to the lamp hood 30 of the fixture. The hollow interior of the top flange 32 forms a channel 36 which opens up directly into the interior of the hood. The conductive wires 20 thus may lead from the open face 19 of the bottom flange 16 through a matching co-axial aperture 34 in the adjacent face 35 of the top flange 32 and thence into the closed interior of the hood 30. Together, the housing 10 and the flanges 16, 32 of the pivot joint 1 form a single interconnected interior cavity through which the wire 20 passes without exposure to the exterior of the fixture 4. The pipe 8 acts as an extension of this sealed cavity, as does the channel 36. Of course, the wire 20 is interrupted within the housing by the ballast coil 24. In any event, a single protected electric circuit is contained within the interconnected interior cavity of the fixture overall.

As seen in FIG. 2, the centers of apertures 18 and 34 share a common transverse axis A. Axis A is perpendicular to the parallel planes of the opposed faces 19 and 35. This allows the faces to be rotated with respect to each other about axis A while apertures 18 and 34 are sealed externally but remain in open communication with each other, when the faces are pressed flush together.

The wires 20 attach to a lamp socket 55 into which is removably attachable a standard compact fluorescent lamp 48. The socket 55 may be of the standard construction which is readily available commercially, i.e. one into which the lamp is inserted axially into an aperture 57 on its face. The socket may be affixed to the hood 30 by suitable means, such as screws 56. The lamp 48 has a base 50 from which protrudes a stabilizing block 52. A rib 53 is typically included on the block 52 for locking the base 50 in the aperture 57. On opposed sides of the aperture 57 are a pair of apertures 60 into which fit the two contact pins 54 of the lamp. As noted, it is normal for the lamp 48 to be inserted into the socket 55 by pushing it into the aperture 57 in the direction of the longitudinal axis of the lamp, as is perhaps better seen in the embodiment shown in FIG. 4, where the apertures 260 for the contact pins and the aperture 257 for the base block are visible.

Preferably, however, a special socket will be designed which will include means for inserting the lamp into the socket from the side. This would allow a narrower hood to be fashioned—because extra room would not have to be provided for axial travel of the lamp 48. For example, a removable or hinged plate 58 might be provided which would provide side access to the block aperture 57. The plate could be secured by screws 59. However, the design of such a new lamp socket is beyond the scope of this disclosure. As noted, the hood 30 simply may be made wide enough to provide enough clearance to allow the use of readily available axial-insertion sockets. Alternatively, for this purpose, the U-shaped side section 31 of the hood (which is opposite from the side on which the socket 55 is mounted) could be made to open.

To form a light reflector 42, the parabolically shaped rear of the hood 30 either may be coated with a reflective layer, or reflective film may be glued to that interior section of the hood. The clear or translucent plastic lens 44 is removably-attachable to the hood within a congruently-shaped opening 43 by means of screws 45, by snap-fit catches (not illustrated), or by the like, so as to completely seal the interior of the hood. Suitable gaskets may be provided for this purpose.

A bolt 38 and nut 39 combination allows the adjacent faces 19, 35 of the bottom and top flanges 16, 32, respectively, to be tightly sealed flush together. Before tightening the bolt 38, the hood 30 may be "aimed", i.e. its vertical axis may be inclined at various selectable angles of tilt, so as to direct the generally horizontal beam of the lamp 48 out of the opening 43 and through the lens 44.

Preferably, the fixtures of this invention will be so constructed as to snap together. The user may not need to work with any screws or bolts at all, other than the one used to bias together the flanges of the knuckle joint (i.e. bolt 38).

Thus, it can be seen that all of the electrical components of the fixture 4 are sealed within its sheltered interior, including the ballast 24 and all of the wiring 20. Nevertheless, the ballast is not located in the interior of the hood 30 nor is it in significantly direct heat-communication therewith. For this reason, it is believed that the fixture 4 may be the first such fixture able to be made waterproof in accordance with the exacting standards of Underwriters Laboratory. However, even if not waterproof, the hoods of these fixtures of this invention still will be significantly smaller and lighter than those of their predecessors.

FIG. 3 illustrates a second embodiment of this invention, namely, pivot joint 101. It is to be noted that, for convenience, the last two positions of the reference numerals of alternate embodiments of the invention duplicate those of the numerals of the embodiment of FIG. 1, where reference is made to similar or corresponding parts. However, it should not be concluded merely from this numbering convention that similarly numbered parts are equivalents.

A hollow pipe 108 leads into the interior of the housing 110, which housing holds an electronic ballast 124 of the type which is starting to be substituted for the magnetic coil type that is incorporated into the previous embodiment (ballast coil 24). The components of the electronic ballast 124 are mounted on a thin printed circuit board. Therefore, the housing 110 may be made significantly thinner. Only the lower portions of the pivot joint 101 are illustrated in FIG. 3. The remaining portions, including the bottom flange, are similar in shape, and identical in function, to those illustrated in FIGS. 1 and 2.

Figure 4:
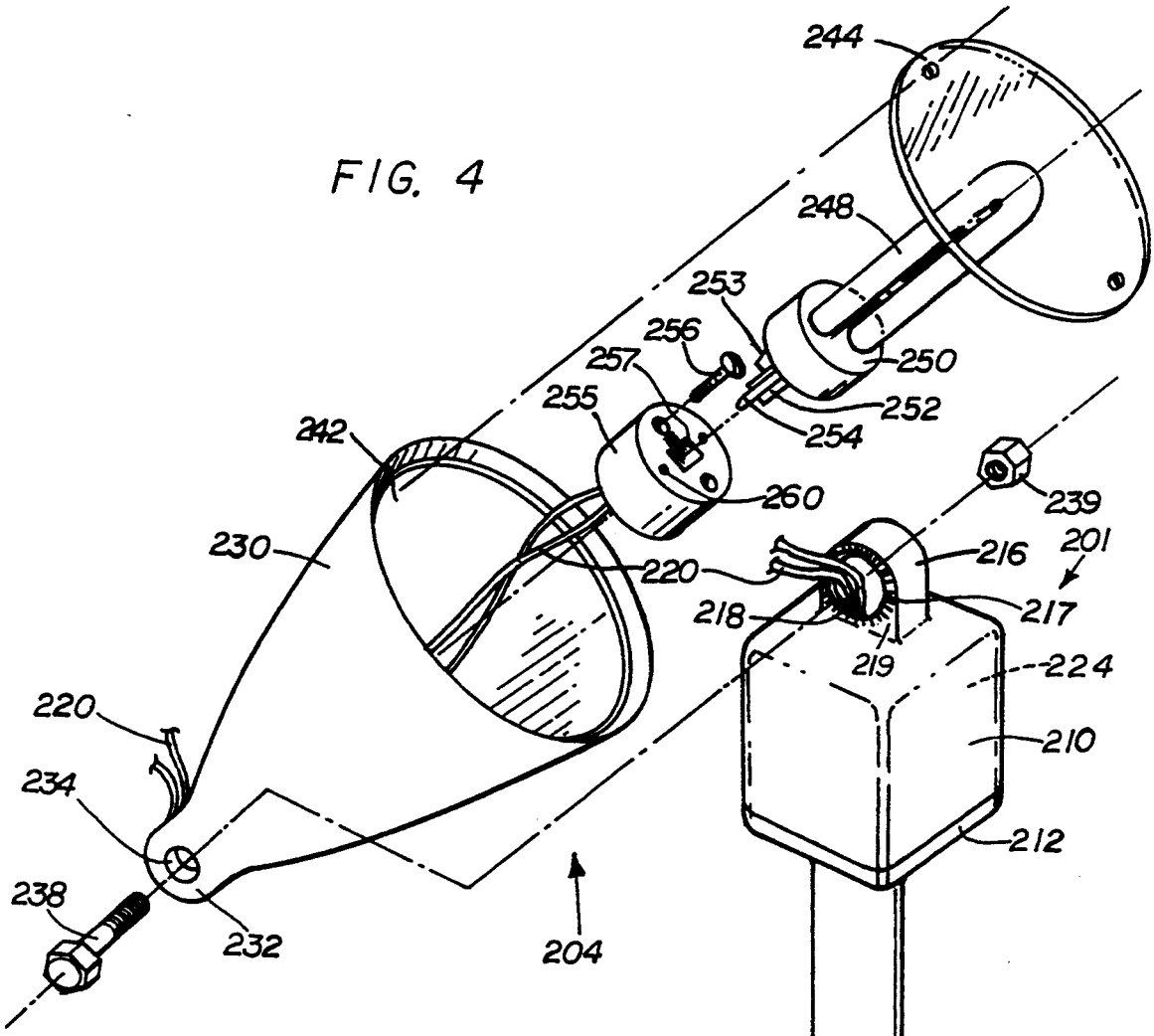
FIG. 4 is an exploded perspective view of an alternate fixture of this invention.

Referring to FIG. 4, there is illustrated therein a knuckle pivot joint 201 adapted within a fluorescent flood-light fixture 204. Fixture 204 is of an alternate type which presents a reflective surface or reflector 242 which is substantially parabolic along all sections which contain, in common, its longitudinal axis. In other words, the shape of the hood 230 of the fixture 201 is generally that of a parabolic cone. Such a fixture projects a relatively focused circular beam when used with a compact fluorescent lamp 248.

Assuming that the fixture 204 is to be supported from below, as drawn, the pivot joint 201 begins with a downwardly-depending hollow electrical conduit or pipe 208, which pipe leads to a base 212 of a housing 210 for a ballast coil 224. As shown in FIG. 4, the pipe 208 may be relatively long, so as to form a pole stand for the fixture 204. However, either fixture 4 or fixture 204 may have either a short or a long bottom pipe, as desired. The bottom pipe of a fixture may connect directly to a junction box, or it may be attached to an intermediate stake or ground pipe (not illustrated).

The base 212 may be releasably secured to the housing 210, or the ballast 224 may be permanently sealed within an integrally molded housing.

A first bottom pivot flange 216 projects upwardly from the ballast housing 210, to which housing it is molded or otherwise rigidly affixed. Preferably, radial knurls 217 project outwardly from an aperture 218 that leads from the face 219 of the bottom flange 216 into the hollow interior thereof.

Electrically conductive wire 220 may be directed from a junction box into the pipe 208. From the junction box, the wire 220 is provided with a fully sealed path through the pipe 208 into the interior of the housing 210 where it connects with the ballast 224. From the ballast, conductive wire 220 leads up through the hollow interior of the bottom flange 216 and out of its aperture 218. Aperture 218 is sealed from the external environment by engagement with a congruent face and aperture 234 of a second top pivot joint flange 232 which leads to a suitable fixture hood 230, as described below.

The top flange 232 for the pivot joint 201 is at least partially hollow, as is the first or bottom flange 216. The top flange is rigidly attached to the lamp hood 230 of the fixture. The hollow interior of the top flange 232 forms a channel (not illustrated) which opens up directly into the interior of the hood. The conductive wires 220 thus may lead from the open face 219 of the bottom flange 216 through a matching aperture 234 in the adjacent face of the top flange 232 and thence into the closed interior of the hood 230.

The wires 220 attach to a lamp socket 255 into which is removably attachable a standard compact fluorescent lamp 248. In this embodiment, wherein there is ample room for axial insertion of the lamp 248 when the lens 244 is removed, the socket 255 will be of the standard axial-insertion construction. The socket may be affixed to the hood 230 by screws 256. Again, the lamp 248 has a base 250 from which protrudes a stabilizing block 252. A rib (or ribs) 253 is typically included on the block 252 for locking the base 250 in the aperture 257. On opposed sides of the aperture 257 are a pair of apertures 260 into which fit the two contact pins 254 of the lamp. As noted, it is normal for the lamp to be inserted into the socket 255 by pushing it into the aperture 257 in the direction of the common longitudinal axis of the lamp 248 and hood 230.

To form a light reflector 242, the parabolically shaped conical interior of the hood 230 preferably will be coated with a reflective layer. The plastic lens 244 is attached to the hood by means of screws or the like so as to completely seal the interior of the hood.

A bolt 238 and nut 239 combination allows the adjacent faces of the bottom and top flanges 216, 232 to be tightly sealed together. In this and other embodiments, as an alternative to the separate nut, one of the flanges may incorporate internal thread means. The bolt may be provided with a thumbscrew head.

Before tightening the bolt and nut, the hood 230 may be "aimed", i.e. its longitudinal axis may be inclined at various selectable angles of tilt, so as to direct the circular beam of the lamp 248 out through the lens 244.

Figure 5:
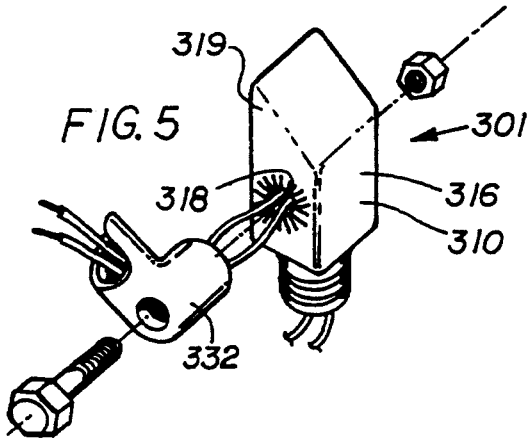
FIG. 5 is an exploded perspective view of another alternate pivot joint.

FIG. 5 illustrates yet another alternate embodiment of the knuckle joint of this invention, namely, pivot joint 301. In this embodiment, the ballast housing 310 is incorporated into the bottom pivot "flange" 316 as an axial extension thereof. An aperture 318 of the face 319 is co-axial with an alignable aperture of the knuckle pivot joint 332 of a suitable fixture hood. In order for this embodiment to be practical, it may be necessary to redesign a standard ballast so that it may be pierced by a screw or to provide an internal supporting yoke or similar thread means for such a screw. Extra clearance will be needed to allow the fixture hood to clear the ballast housing 310. For these reasons, use of the pivot joint 301 is likely to be limited to applications wherein a very short pivot joint is required.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. Therefore, the above description and illustrations should not be construed as limiting the scope of the invention which is defined by the appended claims.

What is claimed is:

1. Pivot joint apparatus for a fluorescent light fixture including:

a first pivot member having a first aperture in a first planar face, the first face lying perpendicular to a transverse axis;

ballast means for a fluorescent lamp contained within the first member;

a second pivot member having a hood containing a socket for a fluorescent lamp and having a second aperture in a second planar face, the second face parallel to the first, the faces rotatable with respect to each other about the axis so that the apertures are sealed externally but remain in open communication with each other when the faces are pressed flush together; and electrically conductive wire passing from the ballast through the apertures to the socket.

2. The apparatus of claim 1 further including:

bolt means for releasably pressing the faces tightly together.

3. The apparatus of claim 1 further including:

congruent interlocking knurls on the faces surrounding the apertures.

4. The apparatus of claim 1 wherein:

the first member is a housing for the ballast, the housing having a first flange protruding therefrom, upon which first flange the first face and first aperture are formed.

5. Pivot joint apparatus for a fluorescent light fixture including:

a first pivot member having a first aperture in a first planar face, the first face lying perpendicular to a transverse axis;

ballast means for a fluorescent lamp contained within the first member;

a second pivot member having a second aperture in a second planar face, the second face parallel to the first, the faces rotatable with respect to each other about the axis so that the apertures are sealed externally but remain in open communication with each other when the faces are pressed flush together;

electrically conductive wire passing from the ballast through the apertures;

bolt means for releasably pressing the faces tightly together;

congruent interlocking knurls on the faces surrounding the apertures;

the first member forming a housing for the ballast, the housing having a first flange protruding therefrom, upon which first flange the first face and first aperture are formed; and a hood containing a socket for a fluorescent lamp, the hood comprising the second member.

6. The apparatus of claim 5 further including:

a second flange protruding from the hood, upon which second flange the second face and second aperture are formed, whereby the conductive wire may pass from the ballast to the socket.

7. The apparatus of claim 6 further including:

a lens sealing the socket within the hood, whereby the conductive wire is sealed from the exterior of the apparatus throughout a path from the ballast to the socket.

8. The apparatus of claim 7 further including:

a reflector in the hood which is substantially parabolic along a plurality of parallel vertical sections taken front to back, but all of whose horizontal sections are linear.

9. The apparatus of claim 7 further including:

a reflector having a longitudinal axis, which reflector is substantially parabolic along all sections which contain in common its longitudinal axis.

10. The apparatus of claim 6 further including:

screw means for releasably pressing the faces tightly together;

congruent interlocking knurls on the faces surrounding the apertures; and a hollow pipe depending from the ballast housing opposite from the first flange through which pipe the conductive wires pass.

11. The apparatus of claim 10 wherein:

the ballast means is an electromagnetic ballast coil.

12. The apparatus of claim 10 wherein:

the ballast means is an electronic ballast the components of which are contained on a printed circuit board.

13. Fluorescent light fixture apparatus including:

a hood containing a socket for a fluorescent lamp;

a pivot joint having first and second pivot flanges rotatably pressed together in interlocking relationship;

a housing for a ballast for limiting the current flow to the socket, the housing connected to one of the pivot flanges, the hood connected to the remaining pivot flange;

electrically conductive wire operatively connecting the ballast and the socket;

and wherein the housing and pivot joint form a single interconnected interior cavity through which the wire passes.

14. The apparatus of claim 13 further including:

ingress means on the housing for leading the wire into the housing to the ballast; and egress means on the pivot flange of the housing for leading the wire out of the housing from the ballast to the other pivot flange.

15. The apparatus of claim 14 wherein:

the ingress means is a hollow pipe and the egress means is a first aperture on the first flange openly communicating with a second aperture on the second flange.

16. The apparatus of claim 14 wherein:

the flanges are located between the hood and the housing.

17. The apparatus of claim 16 further including:

a bolt releasably pressing the flanges together.

18. The apparatus of claim 17 further including:

a U-shaped fluorescent lamp of the compact, super compact or miniature type.

19. Pivot joint apparatus for a fluorescent light fixture including:

a housing containing a ballast for a fluorescent lamp, the housing having a first flange protruding therefrom, upon which first flange are formed a first aperture in a first planar face;

a hood containing a socket for a fluorescent lamp, the hood having a second aperture in a second planar face, the second face parallel to the first, the faces releasably pressed together, the faces flushly rotatable with respect to each other so that the apertures are sealed externally but remain in open communication with each other;

bolt means for releasably pressing the faces tightly flush together;

electrically conductive wire passing from the ballast through the apertures to the socket; and a lens sealing the socket within the hood, whereby the conductive wire is sealed from the exterior of the apparatus throughout an interior path from the ballast to the socket.

20. The apparatus of claim 19 further including:

a second flange protruding from the hood, upon which second flange the second face and second aperture are formed.

21. Pivot joint apparatus for a fluorescent light fixture including:

a first pivot member having a first aperture in a first face, the first face intersected by a transverse axis;

a ballast for a fluorescent lamp contained within the first member;

a second pivot member having a second aperture in a second face, the second face pressed against the first, the faces rotatable with respect to each other about the axis;

electrically conductive wire passing from the ballast through the apertures; and a socket for a fluorescent lamp connected to the wire, the rotatable faces interposed between the ballast and the socket.

22. The apparatus of claim 21 further including:

a bolt passing through the apertures for releasably pressing the faces tightly together.

23. The apparatus of claim 21 wherein:

the first member is a housing for the ballast, the housing having a first flange protruding therefrom, upon which first flange the first face and first aperture are formed.

* * * * *